United States Patent [19]

Hebbel et al.

[11] 4,042,748

[45] Aug. 16, 1977

[54] PROCESS FOR IMPROVING COATING COMPOSITIONS FOR PAPER AND PAPER SUBSTITUTES BY USE OF POLY(HYDROXYALDEHYDOCARBOXYLATE) DISPERSING AGENT

[75] Inventors: Gerhard Hebbel, Traisa; Horst Krueger, Darmstadt; Heinz Haschke; Gerhard Morlock, both of Grossauheim, all of Germany

[73] Assignee: Deutsche Gold- und Silber-Scheideanstalt vormals Roessler, Frankfurt am Main, Germany

[21] Appl. No.: 382,225

[22] Filed: July 24, 1973

[30] Foreign Application Priority Data

July 26, 1973 Germany ..... 2236595

[51] Int. Cl.[2] ..... C08L 81/00; B32B 5/16; C09C 3/10

[52] U.S. Cl. ..... 428/323; 162/168 R; 260/29.6 H; 260/67 UA; 260/8

[58] Field of Search ..... 162/164 R, 168 R; 260/67 UA, 29.6 H, 8

[56] References Cited

U.S. PATENT DOCUMENTS

| | | | |
|---|---|---|---|
| 2,809,186 | 10/1957 | Smith | 260/67 UA |
| 3,227,688 | 1/1966 | Kern et al. | 260/8 |
| 3,235,493 | 2/1966 | Kaupp et al. | 260/67 UA |
| 3,402,100 | 9/1968 | Melchick | 162/164 R |
| 3,597,374 | 8/1971 | Nagan | 260/8 |
| 3,825,498 | 7/1974 | Altenschopfer | 260/47 UA |
| 3,902,958 | 9/1975 | Breen et al. | 162/164 EP |
| 3,942,995 | 3/1976 | Ichikawa et al. | 260/8 |

OTHER PUBLICATIONS

Pezzaglia et al. vol. 48, No. 5 May 1965 Tappi.

Encyclopedia of Polymer Science and Technology vol. 1 - Interscience - 1964 - pp. 160-177.

*Primary Examiner*—Joseph L. Schofer
*Assistant Examiner*—Peter F. Kulkosky
*Attorney, Agent, or Firm*—Beveridge, DeGrandi

[57] ABSTRACT

A process for improving the processability of a coating composition for paper and paper substitutes in which the composition contains at least one undissolved finely divided inorganic substance, organic substance, or mixture of such substances in a system comprised mainly of water, wherein the process comprises mixing into said system about 0.05 - 5.0 percent by weight of at least one dispersing agent consisting essentially of a polymer derived from specified units containing carboxyl, carboxylate, carbonyl and/or hydroxyl groups. A coating composition is provided.

16 Claims, No Drawings

PROCESS FOR IMPROVING COATING COMPOSITIONS FOR PAPER AND PAPER SUBSTITUTES BY USE OF POLY(HYDROXYALDEHYDOCARBOXYLATE) DISPERSING AGENT

This invention relates to a process for the improvement of the processability of coating compositions for paper and paper substitutes. The coating compositions are based on dispersions of undissolved, finely distributable inorganic and/or organic substances in systems comprised mainly of water. Binders and customary coating composition additives can be employed.

Coating compositions frequently contain undissolved finely divided inorganic and/or organic substances uniformly dispersed in a system comprised mainly of water. In the production and processing of such coating compositions, it is naturally desirable that these compositions remain stable as long as possible; that is, it is desirable that the compositions do not lose their homogeneous composition, settle on standing or experience substantial changes in their composition or processing properties (such as viscosity, particle size of the dispersed or suspended particles or particle aggregation). It is further desired that these coating compositions be capable of being readily processed, such as by spreading, pouring, spraying or application by rollers, and also that the composition be capable of being prepared with as high a solids content as possible. Without the use of special "processing aids", this last requirement of high solids content is incompatible in most cases with the demands for good processability and stability. Naturally, an improvement in processability can often be achieved by the simple addition of a suspension or dispersing agent. This measure, however, runs counter to the aforementioned requirement for as high a solids content as possible, since it necessitates a particularly lengthy, expensive and uneconomical drying process. Furthermore, in some cases it can result in an undesirable penetration of the substrate by the suspension or dispersion medium.

Moreover, an excessive dilution of a coating composition can lower the stability of the composition to a point where premature settling will occur.

Ease of processability and economy in processing can be achieved by a considerable lowering of the viscosity of the coating composition, or by the production of a stable coating composition having a relatively low viscosity and a praticularly high solids content. It is the objective that such coating compositions be capable of being processed by all of the conventional coating processes within the limits of the viscosity of the composition and the output of the coating installation relative to the speed of application. The coating composition should be capable of forming a homogeneous layer in a desired thickness as well as being capable of being dried at a rate which will result in a decrease in processing time and thus an increase in profitability. It is of course, where possible, desirable to obtain a coating of higher quality (homogeneity) on the surface of the coated substrate. Therefore, suitable processing aids must, among other things, be capable of lowering the viscosity of a coating composition. The lowered viscosity must be as stable as possible with the lapse of time.

Generally, processing aids exhibit their effects at relatively low levels of concentration (i.e., below 10% by weight, related to the solids content). By decreasing the concentration of the processing aids, it might still be possible to observe a slight decline in viscosity of the coating composition, or else a viscosity which is stable with the lapse of time.

If the concentration of the processing aid is reduced below a certain optimum level, an exceedingly rapid rise in viscosity is observed together with a rapid decrease of the stability of the coating composition.

Not only is it desirable to stabilize a coating composition, but it is also desirable to protect such compositions from discoloration or susceptibility to coagulation when heavy metal ions are present in the composition.

Processing aids capable of improving the processability of a coating composition must also be capable of preserving these desirable properties of the composition in as an ideal a state as possible.

The following materials are known for use as processing aids in coating compositions, especially for the stabilization and lowering of viscosity of such compositions: polyphosphates, silicates, citrates, alkyl or aryl sulfonates, lignine sulfonates, adipic acid derivatives and polycarboxylates. All of these known substances are accompanied by more or less serious disadvantages when used as processing aids in coating compositions. For example, polyphosphates hydrolyze relatively quickly in aqueous systems — especially at elevated temperatures — to form low molecular weight phosphates having reduced effectiveness. (Kirk and Othmer "Encycl. Chem. Techno., " 2nd Ed. Vol. 15, P. 252 ff., Intersci. Publ., J. Wiley, N.Y.: W. J. S. Laseur, Notes of Paper Manufacture 14, 1971, 567 ff).

The effectiveness of the silicates and citrates as processing aids in coating compositions is not always high. The silicates and citrates, therefore, are generally used for special purposes, and have not found wide acceptance over a broad range of uses as processing aids in coating compositions.

A serious disadvantage of the alkyl and aryl sulfonates, and also the lignine sulfonates and adipic acid derivatives, is their tendency to exhibit strong surfactant properties. They are, therefore, inclined to form undesirable foam, or depending upon their functional groups, often enter into undesirable chemical reactions with pigments contained in the coating compositions (e.g., some optical brighteners).

Furthermore, the effectiveness of the citrates in improving the processability of coating compositions is largely dependent upon the pH of the composition. The citrates are generally only useful when the pH is about neutral. Their effects as processing aids diminish very rapidly when the pH is in the acid range.

The polycarboxylates used in the prior art as processing aids in coating compositions are somewhat more hydrostable than the polyphosphates. Because of their relatively high molecular weights, however, it is considerably more difficult to put them into a solution required for their use. Furthermore, since they do not readily biodegrade, their use presents a danger of their becoming contaminants in natural waters, and furthermore, can interfere with the natural biological equilibrium of these waters.

Accordingly, there exists a need in the art for a process for improving the processability of a coating composition for paper and paper substitutes. The coating composition containing undissolved, finely divided inorganic and/or organic substances in a system comprised mainly of water should exhibit good stability, ease of application to a substrate, homogeneity, resistance to the adverse effects caused by the presence of heavy metal ions and capable of having a high solids content.

Accordingly, this invention provides a process for improving the processability of a coating composition for paper and paper substitutes. The composition contains at least one undissolved, finely divided inorganic and/or organic substance in a system comprised mainly of water. The process of this invention comprises mixing into the aqueous system about 0.05 - 5.0% by weight of a dispersing agent related to the weight of solid substances in the coating composition. The coating composition can contain a conventional binder and the customary coating composition additives. The dispersing agent consists essentially of at least one polymer having an average degree of polymerization of about 10 - 500. The polymer is derived from:

a. Y + W/2 — 2Z mole percent units of the general formula (I)

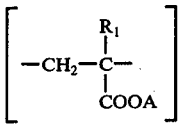

b. U — W mole % units of the general formula (II)

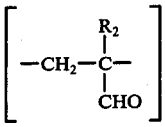

c. Z mole % units of the general formula (III)

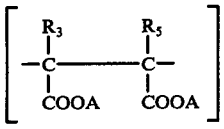

d. W/2 mole % units of the general formula (IV)

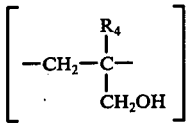

e. V mole % units of the general formula (V)

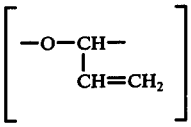

In the foregoing general formulae, U is about 12 - 47, V is about 1 - 25, W is about O - U, Y is about 100 - (U + V + Z), and Z is about 0 - 20. A signifies an alkali metal, hydrogen or ammonium ion, $R_1$ signifies hydrogen, methyl, hydroxy-methyl, ethyl, chlorine or bromine. $R_2$ and $R_4$ are the same or different and signify hydrogen or hydroxymethyl. $R_3$ and $R_5$ are the same or different and signify hydrogen, methyl or ethyl; and whereby the W unlike zero, the quotient of mole percent carboxyl or carboxylate groups to mole percent hydroxyl groups is about 2 - 16.

As used herein, the expression "coating composition" is intended to mean dispersions of suspensions of inorganic and/or organic substances, dispersion and suspension agents, and optionally binders and/or conventional coating composition additives. The dispersion or suspension media are comprised mainly of water; i.e., they contain at least about 70% by weight water, preferably at least about 80% by weight water. It is particularly preferred that they contain at least about 90% by weight water. They can also contain organic solvents in concentrations which are completely miscible with water at the application temperatures and conditions. Preferably the organic solvents are mono- and/or multivalent alcohols.

The coating compositions produced according to this invention can be applied to the surfaces of paper and paper substitutes for the purpose of improving the appearance (e.g., opacity, structure and surface properties, such as color, lustre, and smoothness), as well as their resistance to contamination and wettability with water, control or prevention of their permeability of steam and/or water, improvement of their printability, control of their roughness or anti-slip properties, adjustment of their adhesion, adsorption and/or friction characteristics, control of their capillary properties, such as absorbency or boundary surface tension.

As used herein, the expression "undissolved, finely divided inorganic and/or organic substances" refers to solid, finely divided colorants which are practically insoluble, or only slightly soluble in aqueous dispersions or suspensions. That is, the expression refers to substances, the optical refractive index and/or light absorption or remission (in the visible spectral range and/or in the so-called near ultraviolet range) of which clearly differ from the optical refractive index or the light absorption and/or remission of the dispersing agent and of the surface to be coated. Typical of the substances to be included within this expression are: natural organic pigments, such as natural mineral colors; substances which are obtained by mechanical processing such as grinding, washing, drying of raw mineral products, such as chalk, marble, ocher, umber, cinnabar, green earth, burned terrade Sienna, china clay, gypsum, kaolin, white lead, zinc oxide, titanium white, talc, satin white; synthetic inorganic pigments obtained by chemical or physical conversion of organic basic substances, such as precipitating or roasting to for example chrome yellow, lead (II/IV) oxide, iron oxide, cadmium and chrome pigments, cobalt blue, Paris blue, ultramarine, white pigments such as lead carbonate, zinc carbonate, barium sulfate, silicic acid; metallic pigments, such as bronzes, silver, gold; natural organic pigments, such as sepia, rubber yellow, Cassel brown, indigo, purple; synthetic organic pigments such as phthalocyanine, so called tarcolors, so-called optical whiteners, polymers and/or elastomers, which fulfill the said conditions.

Of particular interest are the customary pigments employed in the paper industry in coating materials or coating mixtures for the production of special papers. Typical of these pigments are: China clay, kaolins, calcium carbonate, talc, barium sulfate (blanc fixe), satin white, zinc oxide (lithopone) titanium dioxide; especially China clay and calcium carbonate (cf. F. Wultsch: "Aides and Their Application in Paper Production", Quentter-Staib publishers, Biberach/Riss, 1966, P. 121 and 122 or Tappi Monograph Series No. 28, 1964, Mack Printing Company, New York).

The "binders" which can be used in practicing this intion are well known in the art. The binders employed are capable of holding the pigment particles together, and at the same time holding together the coating material with the carrier material. The binder is also capable of preventing too great a penetration of the coating material or its individual components in the carrier material. Typical of the binders are: casein, starch and starch derivatives, such as partly hydrolyzed or oxidized starch or dextrine, soy protein, animal glue, alginates; cellulose derivatives, such as carboxy methyl cellulose, methyl cellulose, hydroxy ethyl cellulose, synthetic, highly molecular plastic solutions, dispersions or emulsions; so called-plastic binders, such as styrene - butadiene copolymers, butadiene-polyacrylonitrile copolymers, poly- (acrylic acid ester) copolymers, polyvinyl acetate, polyvinyl alcohol, etc. Other suitable binders will readily be apparent to those skilled in the art of paper manufacture and coating compositions used therein.

The expression "coating composition additives" will be understood to include additives conventionally used in modifying or controlling the properties of coating compositions. Typical of these materials are viscosity regulators, foam regulators, means for influencing water binding capacity resistance, wax dispersions, softeners, conservation agents, aids for producing a satin finish, water softening agents and agents for masking undesirable metal ions. A more detailed listing of "binders" and "coating composition additives" which can be employed in practicing this invention are described by F. Wultsch: "Aids and Their Application in Paper Production," Guentter - Staib publishers, Biberach/Riss, 1966; in Tappi Monograph Series No: 25, Mack Printing Co., New York (1963). The disclosures of these references are incorporated herein by reference.

The polymers employed as processing aids in practicing this invention are polycarboxylates, which also contain as functional groups carbonyl and/or hydroxyl groups in addition to a preponderance of carboxyl or carboxylate groups. Depending upon whether the polymers contain units of the above general formulas (II) and (IV), and in what proportions these units are present, the polymers can be characterized as poly(aldehydocarboxylates) — for short PAC —, poly (hydroxycarboxylates) — for short POC — or poly (hydroxyaldehydocarboxylates) — for short PAC or POC depending upon their predominant characteristics. The polymers employed in this invention do not exhibit the above described disadvantages associated with known proceesing aids, or exhibit them to a considerably lesser extent. For example, the polymers employed herein are largely hydrostable even at elevated temperatures. Further, they are largely independent of the pH of the system; they are effective over a borad pH range from acid to alkaline. In the so-called "closed bottle test" (GF test) according to W. K. Fischer (Tensides 8, 4, 1971, 182 ff), the polymers employed in practicing this invention exhibit biodegradation GF rates, depending upon the average degree of polymerization, between 20 - 40% of the theoretical biochemical oxygen requirement after 30 days of experimentation. The low molecular weight polymers (average degree of polymerization below 40) exhibit substantially complete biological decomposition according to this test. The piolyacrylates, on the other hand, exhibit values of only 7 to 10% of the theoretical biochemical oxygen requirement under the same conditions in the GF test after 30 days of experimentation. Moreover, the polymers employed in practicing this invention exhibit practically no surfactant characteristics which would ordinarily lead to the formation of foam.

The coating compositions containing the polymers in accordance with this invention are less sensitive to traces of heavy metal ions than similar coating compositions made with the known processing aids.

The polymers employed as processing aids in accordance with this invention are used in concentrations of about 0.05 - 5% by weight, preferably about 0.1 - 3% by weight. A concentration of about 0.1 - 2% by weight is particularly preferred. The weight percent of the polymer is expressed on the basis of the total solids content of the coating composition.

The average degree of polymerization of the polymers is about 10 - 500, preferably about 10 - 300, with about 20 - 100 being particularly preferred. The data concerning the average degree of polymerization is to be understood in such a way that the values 10, 20, 100, 300 or 500 correspond to a reduced viscosity as measured in a 1% solution of free poly(aldehydocarboxylicacids) of 0.047, 0.060, 0.095, 0.200 or 0.300 deciliter per gram. The 1% poly(aldehydocarboxypic acid) solutions needed for the measurement are prepared by treating the free poly(aldehydocarboxylic acids) with corresponding quantities of a 5% aqueous $SO_2$ solution. After complete dissolution has occured one must fill up again with the same volume of 10% aqueous NaCl solution. The viscosity measurement takes place at 20° C. In the case of the poly(hydroxycarboxylates) and poly(hydroxyaldehydocarboxylates) the reduced viscosity of the poly(aldehydocarbonic acids) constituting their base is measured.

With respect to the dispersing agents of the prior art, it was known that the effectiveness of the agent was dependent upon the number of functional groups in the molecule capable of dissociation (for example, polyphosphates are better dispersing agents than ortho phosphates, and polyacrylates are far superior as dispersing agents to citrates and gluconates). In view of this fact, it is suprising that the polymers employed in this invention are more effective, depending upon their use, than polyacrylate dispersing agents, since functional carboxylate groups are partially replaced by aldehyde or hydroxy methyl groups not capable of dissociation.

Furthermore, the polymers used in this invention are capable of forming water soluble complexes with metal ions over a wide concentration and pH range. These complexes exhibit good stability. As a result, the polymers employed in this invention obviate the adverse effects which might result if metal ions are present in the dispersion agent and/or substance to be dispersed (e.g., discoloration, formation of deposits and sensitizing effects). The ability to form complexes with metal ions is possibly the reason for the superiority of the dispersing agents employed in this invention in comparison with the dispersing agents of the prior art, at least when used with many inorganic dispersed phases (e.g., $CaCO_3$, CdS). Further, a better (chemi) - sorption of the dispersing agent on the surface of the dispersed phase is assured.

The units having the general formulas (I) to (V) making up the polymers employed in this invention are expressed in basic mole % according to E. Trommstorff, i.e., as the mean number of the pertinent formula units per 100 formula units (I) to (V) in the polymer molecule.

Among the parameters (U, V, W, Y and Z), which define the number of units of the general formulas (I) to (V) in the polymers, U is about 12 - 47, preferably about 20 - 47, especially about 22 - 47, V is about 1 - 25, preferably about 5 - 20, especially about 5 - 15; W is about 0 (i.e., zero) - U, preferably about 0.3U to about U, especially about 0.5 U to about U; Y is about [100 - (U − V + Z)] and Z is about 0 (i.e., zero) − 20, preferably about 0 (i.e., zero) − 10, especially about 0 (i.e., zero).

Furthermore, for polymers in which W is not equal to zero, which therefore contain units of the general formula (IV), the quotient of mole % carboxyl groups or carboxylate groups divided by mole % hydroxyl groups is about 2 - 16, preferably about 3 - 9, especially about 4 - 8.

Among the polymers employed in this invention, the poly (hydroxycarboxylates), i.e., polymers for which W is practically equal to U, and therefore which have no or at most a very small portion of units of the general formula (II), are particularly favored, since they are superior with regard to effectiveness as dispersing agents, oxidation, temperature and light resistance, as well as chemically inert behavior as compared to the substances that are to be dispersed. The poly (aldehydocarboxylates), i.e., polymers for which W is practically equal to zero, which therefore have no or only a very small portion of units of the general formula (IV), are less preferred. Poly (hydroxyaldehydocarboxylates) i.e., polymers which contain units of the general formula (II) as well as units of the general formula (IV), generally assume a middle position.

The preparation of the polymers employed in this invention can be accomplished according to known methods. Thus, the poly (aldehydocarboxylates) can be produced particularly favorably, above all in view of their suitability as processing aids for coating compositions, by oxidative polymerization of acrolein, or by oxidative copolymerization of acrolein with acrylic acid, methacrlic acid, ethacrylic acid, $\alpha$-chloracrylic acid or $\alpha$-bromoacrylic acid, by oxidative terpolymerization of acrolein with the above mentioned $\alpha,\beta$- unsaturated monocarboxylic acids and $\alpha,\beta$-unsaturated dicarboxylic acids optionally substituted by methyl groups or ethyl groups. The polymerization conditions are selected such that the proportions of the polymer of units of the general formulas (I), (II), (III) and (V) lie within the stated ranges, and the required degree of polymerization is maintained. Peroxides and peracids can be used as oxidizing agents and at the same time as polymerization initiators. Preferably $H_2O_2$ is used. The COOH— and CO— content of the polymers can be adjusted in the oxidative polymerization by the quantities of, for example, acrolein, acrylic acid and oxidation agent employed. Since the peroxide compound acts simultaneously as a regulator, it is possible to influence the degree of polymerization by controlling its concentration relative to the monomer.

The terminal groups of the polymer can be hydroxyl groups, carboxyl groups, carbonyl groups, $CH_2OH$— groups and semi- acetalic groups of the type:

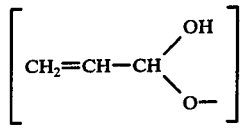

(VIa)

The terminal groups can also be vinyl groups or hydrogen atoms, for example in the form of groups of the type:

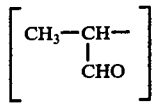

(VIb)

or

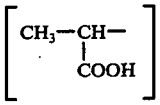

(VIc)

Further, radicals of the catalyst used can occur as terminal groups. The terminal groups are not critical to the use of the polymers according to this invention.

The homo- or copolymerization of acrolein can be carried out and is conducted in a manner dependent upon the carboxyl group content desired in the polymer. Either solution or precipitation polymerization, preferably in an aqueous medium, can be employed. When using peroxidic compounds as oxidizing agents, it is recommended that the latter be added to a reactor, optionally with the comonomer or a part of it in an aqueous solution or suspension, and then the acrolein added, possibly mixed with the remaining comonomers, at an elevated temperature of, for example, about 50° - 100° C.

In case of solution polymerization, the polymers obtained, optionally after concentration of the solution, can be used directly in further reactions. It often is desirable to deactivate any of the oxidizing agent remaining in the solution, such as by the addition of a small quantity of $MnO_2$ or activated charcoal. It is also possible to precipitate the polymers from their solutions with the aid of a dilute acid, such as hydrochloric acid.

Residual monomers can be recovered from the reaction mixture, e.g., by distillation. In this instance, the distillation residue is a highly concentrated aqueous solution of the polymer which can be subjected to further reactions if desired. The distillation can also be carried out to dryness, in which case, the polymer is obtained in solid form.

When carrying out a precipitation polymerization, the polymers can easily be separated by filtration. The residual monomers are then contained in the filtrate, and can be reused in that form. The precipitation polymers can be further purified with water, and optionally by conducting air through the polymers.

The units of the type (II) can also be present in the poly (aldehydocarboxylates) in wholly or partly hydrated form or as cyclic structures resulting from reactions with adjacent groups. Cyclic, acetalic and acylalic structures which develop (IIa)

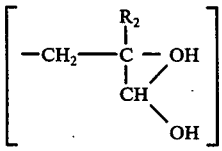

(IIb)

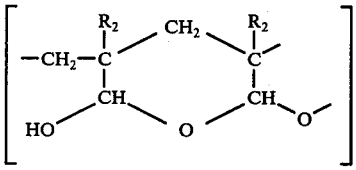

(IIc)

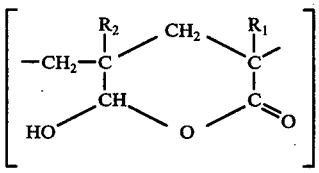

These special structures are in a readily reversible equilibrium with the simple, open carbonyl sturcture (II) and have no special significance when employed in this invention.

When the poly (aldehydocarboxylic acids) produced according to the above mentioned process are neutralized with an alkali metal hydroxide or with ammonia, the corresponding poly (aldehydocarboxylates) are obtained in which A can have the previously mentioned meanings other than hydrogen.

The preparation of the poly (hydroxyaldehydocarboxylates) and poly (hydroxycarboxylates) employed in this invention can also be accomplished according to known techniques. Further, polymers which were made by the oxidative polymerization of acrolein or by the oxidative copolymerization of acrolein into the previously described poly (aldehydocarboxylates) can be converted into the poly (hydroxyaldehydocarboxylates) or poly (hydroxycarboxylates) by subsequent treatment of the polymerizates with a strong base, especially with an alkali metal hydroxide according to the Cannizzaro reaction. The treatment with a strong base can also take place with simultaneous condensation of formaldehyde. There will then be obtained polymers which additionally have units of the general formula:

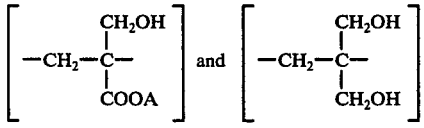

These units correspond to the general formulas (I) and (IV) when $R_1$ an $R_4$ are each hydroxy methyl. Whenever the treatment of the poly (aldehydocarboxylates) with a strong base according to Cannizzaro is continued to a complete conversion of all of the units of the general formula (II) originally present, then poly (hydroxycarboxylates) result; if it is carried out only to partial conversion, then poly (hydroxyaldehydocarboxylates) are obtained.

The poly (aldehydocarboxylic acids) initially obtained, can be reacted with a strong base in an aqueous solution, optionallly in the presence of formaldehyde. In this case, it is possible to add the formaldehyde in about stoichiometric quantities to the aldehydic group present in the polymer, and subsequently stir it for some time at ambient temperature, or at elevated temperatures up to about 100° C., preferably at 20 ° to 50° C., while gradually adding alkali. After about two hours, the conversion is from about 60 to 70% of theoretical, and can rise within 24 hours to 90 – 100% of theoretically complete conversion. In a solution reaction, there results a solution containing an excess of alkali in addition to the salts of the poly (hydroxyaldehydocarboxylic acids) or poly (hydroxycarboxylic acids). They can be evaporated to dryness. By precipitation from the reaction medium, e.g., with methanol, salts are obtained in a particularly pure form. It is also possible prior to concentration to neutralize the solution with a dilute acid, e.g., hydrochloric acid or preferably formic acid, sulfuric acid or phosphoric acid, or to precipitate the free acids.

Excess alkali should only be neutralized with acids, the salts of which do not interfere with the use of polymers in accordance with this invention. The use of, for example, carbon dioxide, hydrochloric acid, sulfuric acid, phosphoric acid, formic acid or acetic acid is recommended for this purpose. But it is also advantageous to use this the poly (hydroxyaldehydocarboxylic acids) or poly (hydroxycarboxylic acids) themselves in a pure solid form or in solution. According to a particularly preferred embodiment, the poly (aldehydocarboxylic acid) obtained as an intermediate product in the above reaction is used; preferably the type readily soluble in water is used in an aqueous solution or in solid form. In this manner, neutral solutions of the salts of the poly (hydroxyaldehydocarboxylic acids) or poly (hydroxycarboxylic acids) are obtained, which can be used directly. In the main chain they have mostly C-C-bonds, and they can be either straight chain or cross-linked. The polymers are built-up from at least two of the above mentioned units (I) to (IV). These units are developed partly during the treatment of the poly (aldehydocarboxylic acids) according to Cannizarro reaction. In the case of this reaction however, intermolecular aldol condensation reactions can occur between the active CH- groups in a position alpha to the aldehydic groups in the poly (aldehydocarboxylic acid) and the carbonyl groups of one or more adjacent chains. As a result, cross linking occurs. The above mentioned units (I) and (IV) as well as possibly (II) and (III), are indispensable for the use of these polymers as dispersing agents.

Units derived from comonomers other than acrolein or acrylic acids can be present in subordinate numbers in the main polymer chain. Typical of other comonomers is maleic acid which leads to units (III). They can be employed in amounts up to about 20 basic mole percent. The solubility in water and/or the acidity, and thus the general useability of the polymers can be controlled by the selection of the consumer.

Whenever the conversion of the poly (aldehydocarboxylate) is carried out with a strong base according to Cannizarro in the presence of formaldehyde, units of the general formulas (I) and (IV) will form, in which $R_1$ and $R_4$ represent hydroxymethyl groups; the degree of crosslinking can be controlled by the quantity of aldehyde used.

Although the oxidative polymerization or copolymerization of acrolein is a radical polymerization, units of the general formula (V) can be present in subordinate quantities up to about 25 basic mole percent in the main chains of the poly (aldehydocarboxylates), and also the poly (hydroxyaldehydocarboxylates) or poly (hydroxycarboxylates) produced from the former by Cannizarro reaction. They develop as a result of polymerization with opening of the carbonyl double bond of the acrolein. With regard to the suitability of the polymers as dispersing agents, they are of no consequence, but they have a certain (positive) influence on the biodegradability of the polymers.

The terminal groups present in the polymer are also practically without significance, and develop depending upon the reaction conditions and the reaction medium. When acrolein and $H_2O_2$ are used, generally at least one of the two terminal groups is always a hydroxyl group. In all other cases, the terminal groups are generally CHO—, $CH_2OH$—, COOH— or $CH_2 = CH$— groups or hydrogen atoms, as well as radicals of the catalyst used.

Since the free acids used according to this invention are very weak acids, aqueous solutions of their salts have more or less high pH values lying in the alkaline range. Beyond that, these substances as polyelectrolytes show the peculiarity, that — contrary to the classic, simple electrolytes — they do not dissociate completely into their ions at all levels of concentration in aqueous solutions ["Primary Dissociation" — J. Am. Chem. Soc. 72 (1950), 2636]. Consequently, in the dilution of such polyelectrolyte — solutions, the primary dissociation effects prevail. As a result, additional carboxylate groups are freed, which, as anion bases, give rise in the hydrolysis equilibrium to a rise in the pH, and only lead to a pH drop after complete primary dissociation corresponding to the behavior of classical, simple electrolytes according to (Oswald's) law of dilution.

The corresponding partial salts of the poly (aldehydocarboxylic acids), poly (hydroxyaldehydocarboxylic acids) or poly (hydroxycarboxylic acids) can also be employed advantageously according to this invention. Therefore, the compounds representing so called "hydrogen salts" can be used according to this invention.

The process of this invention is effectively carried out by dissolving the polymers in the coating composition in concentrations of about 0.05 - 5% by weight, preferably about 0.1 - 3.0% by weight, especially about 0.1 to 2.0% by weight related to the desired solids content of the coating composition. Optionally, at least a part of the binder and other coating composition additives can be added with the polymers. The finely distributable inorganic and/or organic substances and the remainder of the binder and additives can then be added to the prepared solution with as complete mixing as possible.

The finely distributable inorganic and/or organic substances are generally employed in amounts of about 40 - 75% by weight. The binder is generally employed in an amount of about 0.2 - 5% by weight. Each of these percentages is related to the total weight of the finished coating composition. The conventional coating composition additives are employed in the usual amounts.

The finely distributable inorganic and/or organic substances are used in the form of powders with at least about 50% by weight of the particles having a maximum diameter of about 50μm. Preferably, at least about 6% by weight of the particles have a maximum diameter of about 25μ m. It is particularly preferred that at least about 70% by weight of the particles having a maximum diameter of about 10μ m. These particle sizes refer to the main fraction of the particles. Larger and smaller particles can be present in subordinate quantities, i.e., quantities of particle sizes corresponding to the customary Gaussian distribution. Blending of these particles in the coating composition is effectively accomplished in a conventional mixer or kneader.

A paper coating composition or a coating composition for a paper substitute — in short a spreadable material or a brushable paint — for application to the surface of paper with a white or tinted covering layer becomes workable only with the use of suitable processing agents. At the same time, the viscosity characteristics of the spreadable material is of paramount importance for its use since only by correct adjustment of the viscosity can the spreadable material be employed in such a way to fulfill the requirements to be made of the paper. The spreading, i.e., the application of the coating composition, can be accomplished inside or outside a paper making machine according to conventional techniques. A large number of processes have been developed to achieve certain requirements, and can be classified according to the following operating principals for the application and spreading of the paint:

a. Brush principle (application by coating brushes),
b. Roller principle (application by roller coating),
c. Spatula principle (application by the stroke of a spatula, and
d. Wet in wet principle (application by the dandy roll in a reverse press).

Since each of these processing principles requires certain, peculiar characteristics of the pigment to be spread, these characteristics must be correctly balanced in the composition, i.e., pigment, dispersing agent, binder, paper additives (additives which permit the achievement of certain qualities or certain effects). Thus, the coating composition is formulated by employing processing aids which permit a lowering of viscosity, foam control, improvement of satin finish, lubricating and hydrophobing agents, plasticizers or agents for the regulation of the water absorptive capacity.

This invention will be more clearly understood by reference to the following examples in which all parts, proportions, percentages and ratios are by weight unless otherwise specified. Viscosity is measured at 20° C. with a rotation viscosimeter ("Rotovisko") of the firm Haake, K. G., Berlin. The selected concentrations of processing agents correspond to about the optimum mean values.

EXAMPLE 1

A pure aqueous paper coating material, containing 72% by weight ground natural calcium carbonate (average particle diameter of 10 μ m) as pigment and containing a sodium hydroxide solution as coating material additive for the adjustment of pH to 9.0 is produced by the process according to this invention as follows.

2g POC—Na-salt are dissolved in 388 g of water completely desalted by ion exchangers. The POC—Na-salt is prepared by oxidative copolymerization of 20 mole percent acrylic acid with 80 mole percent acrolein by 20% by weight aqueous $H_2O_2$ solution (0.9 moles $H_2O_2$ per mole acrolein) at 65° C., followed by neutralization, reaction with NaOH according to Cannizzaro and subsequent neutralization with a residual portion of the stated copolymer. The POC-Na-salt is characterized by the parameters: average degree of polymerization = 12; $COO^-$: $OH^-$ratio = 3.2 (taking into consideration of the terminal groups); U = 24.5; V = 11.0; W = 22.5; Y = 64.5; Z = 0. Subsequently it is stirred in a Netzsch - kneader for 10 minutes (inside wall V-4A high grade steel,3l volume; Cowles disk as stirring mechanism). After addition of $CaCO_3$ is complete, stirring is continued for another 5 minutes, then the pH value of the material is adjusted to 9.0 by adding NaOH drop by drop.

A well spreadable, stable (i.e., unchanged on its viscosity even after standing for 3 days at 20° C.) coating composition having a viscosity of 109 cps is obtained.

For comparative purposes, another coating composition is prepared using the same measures as described before but with a commercial coating composition processing aid, namely a polyacrylic acid - sodium salt, instead of the POC-Na-Salt. This other composition exhibits a higher viscosity (144 cps) and lower stability (rise in viscosity within 3 days by, on the average, about 10 cps per day) than the coating material produced according to the process of this invention.

EXAMPLE 2

In an experiment similar to Example 1, a coating composition likewise containing 72% by weight of $CaCO_3$ (as described above) is prepared. However, there is employed a PAC-Na-salt produced oxidative copolymerization of 50 mole percent acrolein and 50 mole percent acrylic acid in aqueous, 20% by weight $H_2O_2$ (0.9 moles $H_2O_2$ per mole acrolein) at about 60° C. and subsequent neutralization with aqueous sodium hydroxide solution. The PAC-Na-salt is characterized by the parameters: average degree of polymerization = 60; U = 18; V = 4; W = 3; Y = 78; Z = 0, as processing aid (again 0.2% related to the weight of pigment added). The mass again proves to be stable in the 3 day standing test at 22° C., and has a viscosity of 111 cps.

EXAMPLE 3

POC-Na-salt is prepared by oxidative copolymerization of 50 mole percent acrolein with 50 mole percent acrylic acid in 20% aqueous hydrogen peroxide (0.9 moles $H_2O_2$ per mole acrolein) at 60° C., followed by neutralization, Cannizzaro reaction and neutralization with 20% $H_2SO_4$. The salt is characterized by the parameters: average degree of polymerization = 60; $COO^-$ : OH ratio 7.7 (taking into consideration the terminal groups); U = 18; V = 4; W = 17.5; Y = 78; Z = 0.

A paper coating composition is then prepared by dissolving 6g (0.3% related to pigment addition) of the salt in 2l of distilled water and adding while stirring (600 rpm., Netzsch kneader with Cowl's disk) 2 kg of china clay (a natural aluminum silicate of the approximate composition $Al_2O_3 \cdot 2\ SiO_2 \cdot 2H_2O$) with 80% of the particles below 2μm diameter, within 20 minutes. After completion of the addition of the pigment, stirring is continued for another 5 minutes at 400 rpm. Adjustment of the pH to 7.8 is accomplished by drop by drop addition of a 50% sodium hydroxide solution. The coating material obtained remains stable after the 3-day standing test at 35° C., and has a viscosity of 28 cps.

A coating composition produced analogously with 0.5% by weight (related to the pigment) of pentasodium triphosphate (sodium tripolyphosphate) as a processing aid exhibits a viscosity of about 45 cps, increases considerably, i.e., by about 20 cps per day, in the course of the 3-day standing test (35° C.)

EXAMPLE 4

A china clay coating composition is produced as described in Example 3. As a processing aid to improve the workability, a POC-Na-salt is used. The salt is prepared by oxidative copolymerization of 50 mole percent acrolein with 50 mole percent acrylic acid in 20% aqueous $H_2O_2$ (0.9 moles $H_2O_2$ per mole acrolein) at 60° C., followed by neutralization and Cannizzaro reaction in the presence of (i.e., with simultaneous condensation of) formaldehyde as well as subsequent neutralization with a radical of the polymerizate produced in the first reaction step. The salt is characterized by the parameters: average degree of polymerization = 60; $COO^-$: OH ratio = 5.8 (including consideration of the terminal groups); U = 16.7; V = 3.4; W = 8.0; Y = 79.9; Z = 0. The processing aid is added in a quantity of 0.1% by weight related to the quantity of pigment used.

A spreading material containing 50% pigment by weight is prepared. The viscosity of the spreading material is 29 cps [compared to polyacrylic acid - NA-salt (same quantity): 40 cps]. The coating composition prepared with the POC-Na-salt remains unchanged even after 3 days, while the comparative sample employing the polyacrylic acid - Na-salt has a viscosity after 3 days of 100 cps.

EXAMPLE 5

993 g of tap water of 14° d H (d H = German degree of hardness) are drawn. In it, 3.0 g processing aid A or B are dissolved. Subsequently, 1000 g of china clay with 80% of the particles having diameters below 2μm, 70 g oxidative degraded starch and 50 g of a 50% by weight aqueous dispersion of a polyacrylic acid ester are added successively while intermixing in a Netzsch - kneader (as described before) at an 800 rpm stirring speed. After 30 minutes of stirring (at 20° C.), and adjustment of the pH to 7.6 with a few drops of 50% by weight NaOH if required, the spreading materials are ready for use.

In case of the test variation *a*, a poly (hydroxy carboxylic acid) - Na-salt as in Example 1 is used as a processing aid A; test variation *b* is carried out with a polyacrylic acid Na-salt as processing aid B. The results are summarized in the following table.

| Variation | Processing Aid | Viscosity of the spreading material | Viscosity of the spreading material after 3 days |
|---|---|---|---|
| a | A | 485 | 485 |
| b | B | 550 | 600 |

As used herein, the expression "alkali metal" is intended to mean a metal selected from Group IA of the Periodic Table of the Elements.

As previously described, this invention enables the dispersion of undissolved, finely divided inorganic substances, organic substances or mixtures of such substances in coating compositions comprised mainly of water. As used herein, the term "undissolved" is intended to mean that the substance and/or substances are substantially insoluble in water.

What is claimed is:

1. Process for coating paper or paper substitutes, said process comprising applying to said paper or paper substitutes a composition containing solid, organic or inorganic coloring particles or mixtures thereof, in a system comprised mainly of water, wherein at least about 50% of weight of said particles or mixtures thereof have a maximum diameter of about 50μm, said composition containing about 0.05–5.0% by weight of a dispersing agent, related to the weight of solid substance in said composition, said dispersing agent consisting essentially of at least one polymer having an average degree of polymerization of about 10–500, said polymer derived from:

a. Y + W/2 mole percent units of the formula (I)

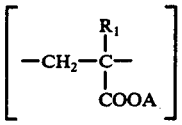

b. U − W mole percent units of the formula (II)

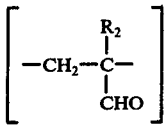

c. W/2 mole percent units of the formula (IV)

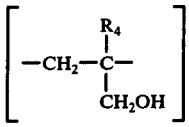

d. V mole percent units of the formula (V)

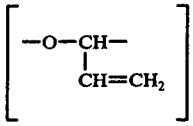

in which U is 12 - 47, V is 1 - 25, W is O - U and Y is [100 − (U + V)]; A is an alkali metal, hydrogen or ammonium ion; $R_1$ signifies hydrogen, methyl, hydroxy methyl, ethyl, chlorine or bromine, $R_2$ and $R_4$ are the same or different and signify hydrogen or hydroxy methyl; and further, when W is not equal to zero, the quotient of mole percent carboxyl or carboxylate groups to mole percent hydroxyl groups is 2 - 16.

2. Process according to claim 1 in which the coating composition contains at least one binder and at least one coating composition additive.

3. Process according to claim 1 in which the polymer is about 0.1 - 3% by weight.

4. Process according to claim 1 in which the polymer is about 0.1 - 2% by weight.

5. Process according to claim 1 in which the polymer has an average degree of polymerization of about 10 - 300.

6. Process according to claim 1 in which the polymer has an average degree of polymerization of about 20 - 100.

7. Process according to claim 1 in which U is 20 - 47, V is 5 - 20 and W is 0.3U to U.

8. Process according to claim 1 in which U is 22 - 47, V is 5 - 15 and W is 0.5U to U.

9. Process according to claim 1 in which A is a sodium ion.

10. Process according to claim 1 in which W is not equal to O, and the quotient of mole % carboxyl or carboxylate groups divided by mole % hydroxyl groups is 3 - 9.

11. Process according to claim 1 in which W is not equal to O, and the quotient of mole % carboxyl or carboxylate groups to mole % hydroxyl groups is 4 - 8.

12. Process for coating paper or paper substitutes, said process comprising applying to said paper or paper substitutes a composition containing at least one undissolved, finely divided inorganic pigment particle, in a system comprised mainly of water, wherein at least about 50% by weight of said inorganic pigment particles have a maximum diameter of about 50μm, said composition containing about 0.05 - 5.0% by weight of a dispersing agent related to the weight of solid substances in said composition, said dispersing agent consisting essentially of at least one polymer having an average degree of polymerization of about 10–500, said polymer derived from:

a. Y + W/2 mole percent units of the formula (I)

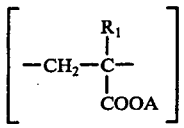

b. U − W mole percent units of the formula (II)

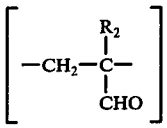

c. W/2 mole percent units of the formula (IV)

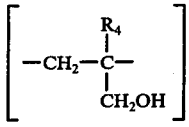

d. V mole percent units of the formula (V)

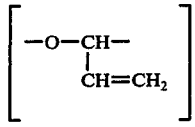

in which U is 12 - 47, V is 1 - 25, W is O - U and Y is [100−(U + V)]; A is an alkali metal, hydrogen, or ammonium ion; $R_1$ signifies hydrogen, hydroxy methyl, methyl, ethyl, chlorine or bromine, $R_2$ and $R_4$ are the same or different and signify the hydrogen or hydroxy methyl; and further, when W is not equal to zero, the quotient of mole percent carboxyl or carboxylate groups to mole percent hydroxyl groups is 2 - 16.

13. Process according to claim 12 in which said inorganic pigment is china clay or calcium carbonate.

14. Process according to claim 12 in which the coating composition contains at least one binder selected from the group consisting of casein, soy protein and animal glue.

15. Process according to claim 12 in which the coating composition contains animal glue or a high molecular plastic solution, dispersion or emulsion as a binder.

16. Process according to claim 13 in which the coating composition contains animal glue as a binder.

* * * * *